United States Patent [19]

Fukuzuka et al.

[11] 4,254,158

[45] Mar. 3, 1981

[54] PROCESS FOR ONE-SIDE HOT-DIP COATING

[75] Inventors: Toshio Fukuzuka, Kobe; Masaaki Urai, Innami; Kenji Wakayama, Kobe, all of Japan

[73] Assignee: Kobe Steel, Limited, Kobe, Japan

[21] Appl. No.: 7,820

[22] Filed: Jan. 30, 1979

[30] Foreign Application Priority Data

| | | | |
|---|---|---|---|
| Jan. 1, 1978 | [JP] | Japan | 53/9656 |
| Jun. 28, 1978 | [JP] | Japan | 53/89630 |
| Jul. 28, 1978 | [JP] | Japan | 53/92981 |

[51] Int. Cl.[2] ..... C23C 1/02; C23C 1/08; C23C 7/00

[52] U.S. Cl. ..... 427/8; 427/431; 427/422; 427/433; 427/432; 427/434.3; 118/410

[58] Field of Search ..... 427/432, 300, 433, 434 A, 427/431, 8, 422; 118/410; 228/37, 260

[56] References Cited

U.S. PATENT DOCUMENTS

| | | | |
|---|---|---|---|
| 2,683,099 | 7/1954 | Hahn | 427/401 |
| 2,937,108 | 5/1960 | Toye | 427/211 |
| 3,058,441 | 10/1962 | Walker et al. | 118/410 |
| 4,069,358 | 1/1978 | Winter et al. | 427/434 A |
| 4,103,644 | 8/1978 | Michels | 118/62 |

FOREIGN PATENT DOCUMENTS

| | | | |
|---|---|---|---|
| 2656524 | 6/1978 | Fed. Rep. of Germany | 427/300 |
| 49-3836 | 1/1974 | Japan . | |
| 49-25096 | 6/1974 | Japan . | |
| 50-125934 | 10/1975 | Japan . | |
| 52-38428 | 3/1977 | Japan . | |
| 1939707 | 7/1975 | United Kingdom | 118/410 |
| 193282 | 3/1967 | U.S.S.R. | 228/37 |

*Primary Examiner*—Ralph S. Kendall
*Attorney, Agent, or Firm*—Oblon, Fisher, Spivak, McClelland & Maier

[57] ABSTRACT

The invention discloses a process for one-sided, hot-dip coating which includes guiding and causing a metal sheet to be coated to travel over a molten metal bath by means of a pair of guide rolls disposed above the bath; sucking a hot-dip coating metal inside the molten metal bath by an electromagnetic pump disposed outside the bath and jetting the hot-dip coating metal through the molten metal bath from a nozzle protruding beyond the surface of the bath between the pair of guide rolls; and bringing the hot-dip coating metal thus jetted into contact with the lower surface of the metal sheet over its entire range in its transverse direction while the metal sheet is travelling, thereby forming a coating layer of the hot-dip coating metal on the lower surface of the metal sheet.

8 Claims, 16 Drawing Figures

PROCESS FOR ONE-SIDE HOT-DIP COATING

BACKGROUND OF THE INVENTION

1. Field of the Invention

This invention relates to a process for one-sided hot-dip coating a metal sheet.

2. Description of the Prior Art

Steel sheet that has been used for automobiles and electric home appliances has been hot-dip coated on both surfaces insofar as corrosion resistance is one of requisites. From the view-point of the ability to weld and paint the steel sheet, however, it is preferred that it has an uncoated surface. Consequently, demand for one-sided, hot-dip coated steel sheet has been increasing and this also is true for metal sheets other than the steel sheet.

Various methods have therefore been proposed as the production process for one-sided hot-dip coated metal sheet such as those listed below, for example;

(1) A method in which two steel sheets are lapped and only non-lapping surfaces are hot-dip coated (such as disclosed in Japanese Patent Laid-Open No. 125934/1975);

(2) Chemicals such as a silicone resin are applied only to the non-coating surface prior to the hot-dip coating (such as disclosed in Japanese Patent Laid-Open No. 3836/1974);

and (3) A gas containing oxygen is sprayed only on one surface in order to form in advance a film which reacts with difficulty to a hot-dip coating metal (such as disclosed in Japanese Patent Laid-Open No. 38428/1977).

Though these methods have certainly succeeded in accomplishing the respective intended objects to some extent, none of them are entirely satisfactory, especially with respect to production cost, productivity and the quality of the product.

On the other hand, there has also been proposed a method wherein a bath surface upheaving or raising device (an impeller as a definite example) is disposed inside a hot-dip coating bath in order to upheave or raise and bring the hot-dip coating metal into contact with the lower surface of a steel strip travelling thereover (Japanese Patent Publication No. 25096/1974). This method, however, is not free from the problem of the construction and materials for the upheaving device. Especially when any fluctuation occurs on the bath surface due to carry-out of the hot-dip coating metal, it becomes impossible to form sufficient upheaval in a stable manner. In such a case, a dross (a metal oxide) formed on the surface of the bath of this kind is also raised or upheaved and brought into contact with the steel strip together with the hot-dip coating metal whereby appreciable finish can not be expected on the coated surface. In order to establish sufficient contact of the hot-dip coating metal with the steel sheet, further, the speed of revolution of the impeller, for example, must be enhanced. However, this tends to result in high ripples on the bath surface or occurrence of splashes that often attach to the non-coating side or to operators and do them an injury.

SUMMARY OF THE INVENTION

The present invention contemplates to rationally solving these drawbacks of the conventional one-sided hot-dip coating techniques and is directed to providing an effective process for one-sided, hot-dip coating in order to obtain a one-sided, hot-dip coated metal sheet having high quality.

The first embodiment of the present invention to accomplish the abovementioned object relates to a process for one-sided, hot-dip coating which comprises the steps of guiding and causing a metal sheet to be coated to travel over a molten metal bath by means of a pair of guide rolls disposed above said bath; sucking a hot-dip coating metal inside said molten metal bath by an electromagnetic pump disposed outside said bath and jetting said hot-dip coating metal through said molten metal bath from a nozzle protruding beyond the surface of said bath between said pair of guide rolls; and bringing said hot-dip coating metal thus jetted into contact with the lower surface of said metal sheet over its entire range in its transverse direction while said metal sheet is travelling, thereby forming a coating layer of said hot-dip coating metal on the lower surface of said metal sheet.

In the first embodiment described above, the second embodiment of the present invention relates to the process for one-sided, hot-dip coating wherein said metal sheet is a steel sheet.

In accordance with the first embodiment described above, the third embodiment of the present invention relates to the process for one-sided, hot-dip coating wherein said hot-dip coating metal is zinc, aluminum, lead and their alloys.

In accordance with the first embodiment described above, the fourth embodiment of the present invention relates to the process for one-sided, hot-dip coating wherein said hot-dip coating metal, said metal sheet to be coated, said nozzle and said pair of guide rolls are held in the atmosphere of a reducing gas or of an inert gas shielded from the external air in order to prevent oxidation of said metal sheet to be coated and said coating layer of said hot-dip coating metal is formed on the lower surface of said metal sheet.

In accordance with the first embodiment described above, the fifth embodiment of the present invention relates to the process for one-sided, hot-dip coating wherein said hot-dip coating metal is jetted by means of said electromagnetic pump and brought into contact with the lower surface of said metal sheet, the height of said hot-dip coating metal from the bath surface is measured by means of a bath surface level detector and the input voltage to said electromagnetic pump is controlled on the basis of the measurement so as to hold the jet height of said hot-dip coating metal at a constant level.

In accordance with the first embodiment described above, the sixth embodiment of the present invention relates to the process for one-sided, hot-dip coating wherein said nozzle has flat mouth extending in the direction of the width of said metal sheet, both end portions of said mouth being expanded more than the central portion.

In accordance with the first embodiment described above, the seventh embodiment of the present invention relates to the process for one-sided, hot-dip coating wherein jetting of said hot-dip coating metal by means of said electromagnetic pump is effected at plural positions in the direction of width of said metal sheet.

In accordance with the first embodiment described above, the eighth embodiment of the present invention relates to the process for one-sided, hot-dip coating wherein the thickness of the coated film of said metal sheet subjected to one-sided, hot-dip coating is controlled by gas wiping.

In accordance the eighth embodiment described above, the ninth embodiment of the present invention relates to the process for one-sided, hot-dip coating wherein said wiping gas is either a reducing gas or an inert gas.

Various other objects, features and attendant advantages of the present invention will be more fully appreciated as the same becomes better understood from the following detailed description when considered in connection with the accompanying drawings in which like reference characters designate like or corresponding parts throughout the several views, and wherein:

BRIEF DESCRIPTION OF THE DRAWINGS

FIG. 8 shows a sectional view of an alternate embodiment of the present invention;

FIGS. 14 and 15 are schematic views of the nozzles used in examples wherein FIG. 14 shows the nozzle for the comparative example and FIG. 15 shows the nozzle working example.

DETAILED DESCRIPTION OF THE PREFERRED EMBODIMENTS

The present invention has been completed as a result of intensive studies in order to put an effective one-sided, hot-dip coating process into practical use on an industrial scale. In accordance with the process of the present invention, a hot-dip coating metal is jetted upwardly from a nozzle protruding beyond the surface of a hot-dip coating metal bath and is brought into contact with the lower surface of a metal sheet travelling at a position higher than the level of the hot-dip coating metal bath by means of a driving force of an electromagnetic pump that is disposed outside the hot-dip coating metal bath. Thus, it is now possible in accordance with the present invention to obtain a one-sided, hot-dip coated metal sheet having high quality.

Though the structure, function and effect of the present invention will now be explained with primary reference to the accompanying drawings showing the embodiments thereof, it is to be noted that the following explanation is not intended to specify and restrict the invention in any manner in the same way as the embodiments set forth in the scope of claim and hence, various changes and modifications could be made suitably in the light of the gist of the invention without departing the scope thereof.

Figure 1:
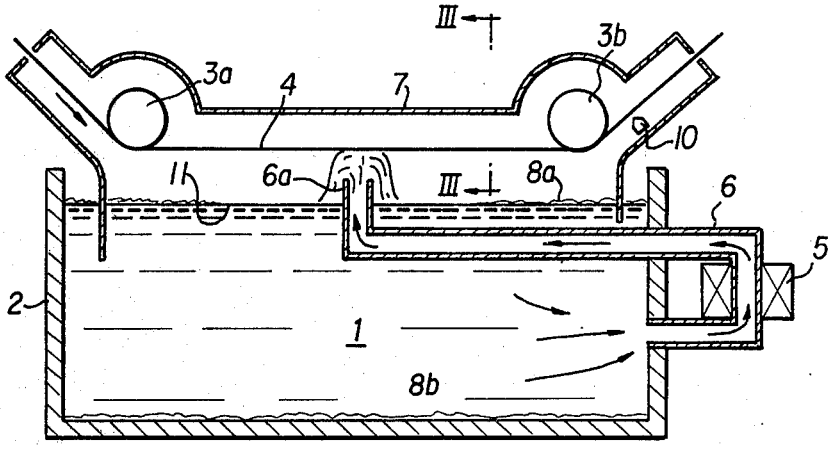
FIGS. 1 and 8 are schematic sectional views showing the condition of the coating work in accordance with the present invention.
Figure 8:
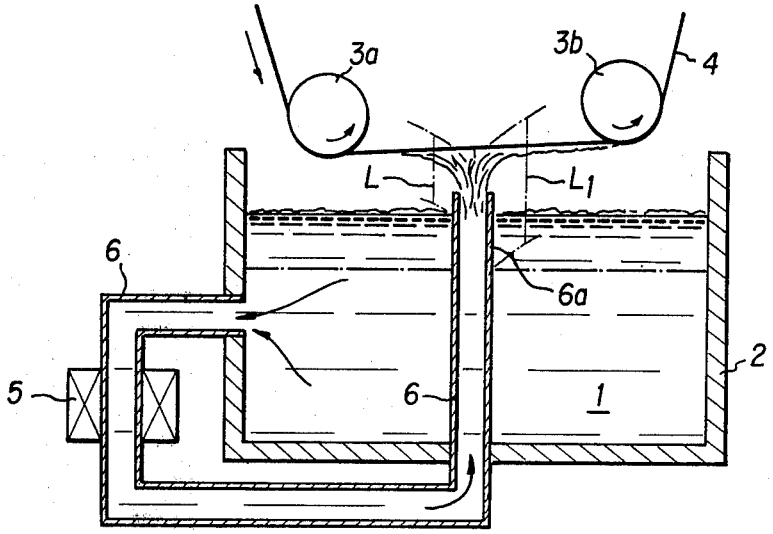

FIGS. 1 and 8 are schematic views showing the process of the present invention wherein reference numerals represent the following members, respectively;

1: hot-dip coating metal, coating bath pot, 3*a*, 3*b*: guide rolls, 4: metal sheet as a material to be hot-dip coated, 5: electromagnetic pump, 6: passage pipe, 6*a*: jet nozzle, 7: air-shielding cover, 8*a*: top-dross, 8*b*: bottom-dross, and 11: bath surface The passage pipe 6 is connected at a proper position on the side wall of the coating bath pot 2, is once taken out of the pot 2, is again introduced into the pot, protrudes beyond the bath surface level at a suitable central position of the pot 2 and is open upwardly. The electromagnetic pump 5 is disposed around the outer circumference of the portion of the passage pipe 6 that is taken out from the coating bath pot. When the inducter forming the electromagnetic pump 5 is actuated, a shifting magnetic field is generated from the multi-layer coil of the primary iron core thereinside and an induced current flows internally through the hot-dip coating metal 1 inside the passage pipe 6. A driving force occurs in the hot-dip coating metal itself due to this shifting magnetic field and the induced current so that the hot-dip coating metal is transferred towards the nozzle 6*a* at the tip of the passage pipe 6 along the route indicated by an arrow and is jetted upward from the nozzle 6*a*. Since the metal sheet 4 travels above the coating bath pot 2 while being guided by a pair of guide rolls 3*a*, 3*b* in this instance, the hot-dip coating metal 1 jetted upwardly from the nozzle 6*a* hits the lower surface of the metal sheet 4 and attaches thereto whereby the excessive hot-dip coating metal is caused to fall into the coating bath pot 2.

In accordance with this process, it is possible to jet and contact a necessary and sufficient amount of the hot-dip coating metal to the lower surface of the metal sheet to be coated. The blow-up quantity of the hot-dip coating metal can be adjusted freely by controlling the voltage of the electromagnetic pump 5 on the basis of a signal from a bath surface level detector (which will be explained in detail elsewhere), even when there is some fluctuation in the bath surface level. It is therefore possible to carry out the one-sided, hot-dip coating work in a stable manner for an extended period even if there is no, or insufficient, supply of metal ingot for the hot-dip coating metal.

In FIG. 1, the air-shielding cover 7 is shown and disposed so that the hot-dip coating metal, the metal sheet as a material to be hot-dip coated, the nozzle and a pair of guide rollers are shielded from the external air and the one-sided, hot-dip coating work is carried out in the atmosphere of a reducing gas (e.g. a $H_2$—$N_2$ type mixed gas) or of an inert gas (e.g. a $N_2$ or Ar gas). This intended to prevent the oxidation of the metal sheet as a material to be hot-dip coated. However, it is practically difficult to perfectly prevent the oxidation of the hot-dip coating metal. Hence, it is unavoidable that a considerable amount of top-dross 8*a* is formed on the bath surface and a considerable amount of bottom-dross 8*b* also is formed due to the reaction between the hot-dip coating metal and the steel sheet. According to the process of the present invention, however, the hot-dip coating metal is sucked up from the intermediate depth of the coating bath pot 2 and consequently, the process of the invention is free from the drawback of the conventional impeller method in that the drosses 8*a* and 8*b* attach to the lower surface of the metal sheet 4 and thus deteriorate the quality of the coated surface.

Figure 2:
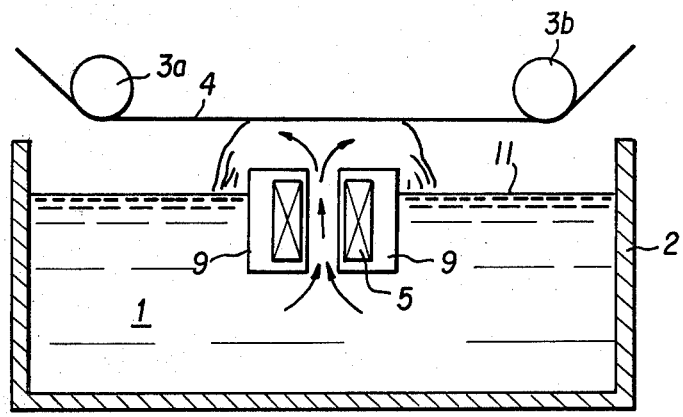
FIG. 2 is a schematic sectional view showing the condition of the coating work in a comparative example of the present invention.

Incidentally, as a method of using the electromagnetic pump for jetting upward the hot-dip coating metal, there may be utilized a method such as shown in FIG. 2 wherein the electromagnetic pump 5 is protected by a heat-resisting material 9 and is then immersed directly into the coating bath pot 2. However, this method involves the following problems. First, heat-resisting and corrosion-resisting measures are essentially necessary for the electromagnetic pump 5, thereby increasing the cost of installation. The service life of the installation itself is also shortened. In addition, since the electromagnetic pump generates heat by means of its own induced current, the pump must be cooled in order to prevent overheating. If the electromagnetic pump is to be cooled, however, the hot-dip coating metal also is cooled necessarily, thus resulting in shortcomings of the stable coating work. In contrast with the above-mentioned method, the electromagnetic pump 5 in the process of the present invention is disposed around the outer circumference of the passage pipe 6 that is taken out from the bath pot 2 as shown in FIGS. 1 and 8 and is not brought into direct contact with the hot-dip coating metal 1. This arrangement eliminates the heat-resisting and corrosion-resisting measures, thus markedly reducing expenses that would otherwise be borne. If a suitable water-cooling copper pipe is provided to a suitable position of the electromagnetic pump 5, overheating of the pump can be easily prevented without lowering the temperature of the hot-dip coating metal. Accordingly, it is possible to secure stable coating work and to extend drastically the service life of the electromagnetic pump.

Figure 3A:
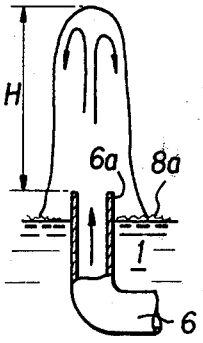
FIG. 3 is a schematic view showing the jetting condition and the upheaving condition of the hot-dip coating metal when the jet nozzle is protruded from the bath surface and when it is immersed in the bath, respectively.
Figure 3B:
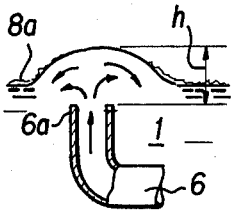
Figure 4:
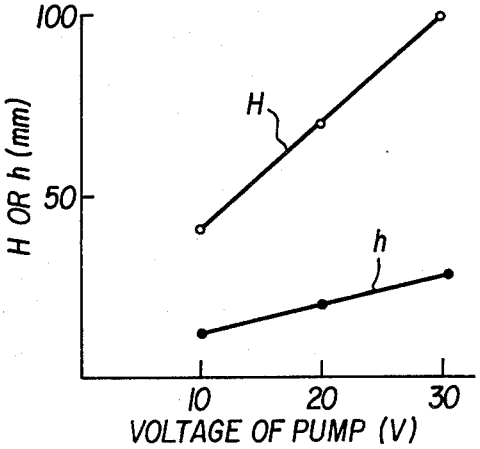
FIG. 4 is a diagram showing the relationships between the voltage of the electromagnetic pump and the jetting height (H) and between the voltage and the upheaving height (h)

In the process of the present invention, it is essentially necessary that the nozzle 6*a* at the tip of the passage pipe 6 protrudes upwardly beyond at least the surface level of the hot-dip coating metal, and this requisite is of utmost significance for the practical coating work for the following reasons. Namely, FIG. 4 shows the relationship between the voltage of the electromagnetic pump 5 and the jet height H of the hot-dip coating metal from the tip of the nozzle when the nozzle 6*a* is protruded upward beyond the bath surface level [FIG. 3(A)] and between the voltage and height of raising or upheaval h of the hot-dip coating metal when the nozzle 6*a* is dipped below the bath surface level [FIG. 3(B)]. As can be seen, it is possible to increase remarkably the jet height H by boosting the voltage of the electromagnetic pump if the nozzle 6*a* is protruded beyond the bath surface level. On the contrary, the height of upheaval h is hardly varied even by elevating the voltage provided that the nozzle 6*a* is dipped deep into the bath surface level.

In other words, if the nozzle 6*a* is protruded, the jet height H can be enhanced and in addition, can be adjusted optionally by adjusting the voltage of the electromagnetic pump. Hence, the jet height H can be easily adjusted to match the fluctuation of the bath surface level, if any, thus leading to an extreme advantage for stable coating work. In comparison therewith, if the nozzle 6*a* is immersed into the bath surface level, the necessary height of upheaval h can not be secured when the bath surface level is excessively upheaved, thereby making the coating inferior or even impossible. In the latter case, the top-dross 8*a* floating on the bath surface is also lifted up simultaneously and brought into contact with the steel sheet whereby the quality of the coated product tends to be deteriorated. In the former case (where the nozzle 6*a* is protruded), on the other hand, no such problem occurs and a product having high quality can be obtained in a stable manner.

Figure 5:
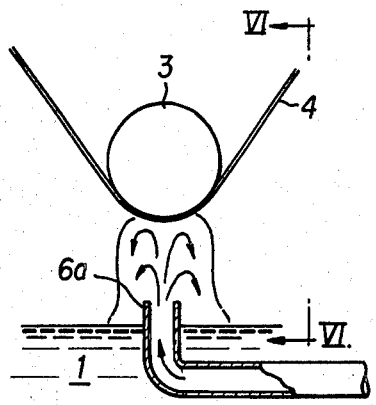
FIGS. 5 and 6 are schematic views showing the condition of the coating work in the comparative example of the present invention.
Figure 6:
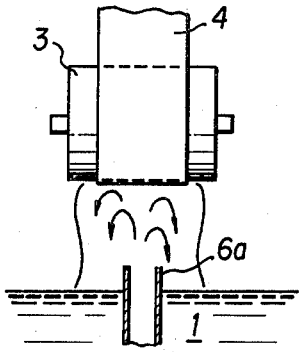

Furthermore, the process of the present invention uses a pair of guide rolls 3*a* and 3*b* as a guide for a metal sheet to be coated such as a steel sheet 4, for example. The use of such means is an essential requirement in order to prevent corrosion of the guide rolls and to enable stable coating work over an extended period. If the steel sheet 4 is to be merely guided over the bath surface of the hot-dip coating metal 1, even a single guide roll 3 such as shown in FIGS. 5 and 6 can suffice. As a matter of fact, this method has so far been widely employed. In accordance with this method, however, if the hot-dip coating metal 1 is jetted upward from the nozzle 6*a* below the guide roll 3, the metal 1 is brought into contact with, and attaches to, the guide roll at portions rather outside the side edges of the steel sheet. Under this condition, if the subsequent steel sheet 4 becomes wider in its width or moves in a zig-zag fashion, the hot dip coating metal 1 attaching to the guide roll 3 is transferred and caused to attach to the upper surface (i.e. non-coating surface) of the steel sheet 4. As a result, troublesome post-treatmemts become necessary such as peel-off of the coating metal attaching to the non-coating surface or cut-off of both side edges of the steel sheet 4. Moreover, the quality of the product deteriorates and the production yield is also lowered. This method further involves the problem of shortening of the service life of the guide roll 3 itself. Hence, maintenance of the installation becomes another problem. To cope with these problems, ceramics or a silicone resin may be lined around the outer circumference of the guide roll 3. In any regard, however, this does not provide a fundamental solution to the problems.

On the other hand, the present invention uses a pair of guide rolls 3*a* and 3*b* so that the hot dip coating metal is jetted upward at a substantially intermediate position between the rolls and thus brought into contact with the steel sheet 4, thereby preventing direct contact of the hot-dip coating metal with the guide rolls 3*a* and 3*b*. Hence, the process of the present invention is entirely free from all the abovementioned problems.

In FIG. 8, the passage pipe 6 and the bath pot 2 are shown as being communicated with each other. Accordingly, if the quantity of the hot-dip coating metal 1 is reduced due to carry-over, etc. and the bath surface is lowered, the level inside the pipe 6, at the nozzle 6*a*, is also lowered in the same way as in the bath surface level (indicated by a dash-and-dot line). As the bath surface level is lowered and the distance $L_1$ between the metal sheet 4 and the bath surface becomes greater, the coating metal would be jetted upward from the bath surface level which is lower (i.e. the distance L between the metal sheet 4 and the bath surface level) if the hot-dip coating metal is blown up under the same condition as before. In such a case, the jet height of the coating metal from the tip of the nozzle 6*a* becomes insufficient by a height corresponding to the head ($L_1$–L) whereby the coating work can not be continued under the optimum coating condition. It is therefore necessary to supplement the coating metal ingot to such an extent that the bath surface level of the coating metal returns to the position indicated by full line. However, since it is by no means easy to maintain the height of the bath surface level at a constant level, such method must be established as to cope with the fluctuation of the bath surface and to enable stable coating work rather under the condition that the bath surface level does fluctuate.

In order to accomplish the above-mentioned object, it is preferred that the hot-dip coating metal be jetted up by the electromagnetic pump to the lower surface of the metal sheet travelling at a position higher than the level of the coating metal and be brought into contact therewith and at the same time, the level height of the coating metal being detected by a bath surface level detector so as to adjust the input voltage applied to the electromagnetic pump on the basis of the detection signal and thus keeping constant the jet height of the hot-dip coating metal to be jetted to the metal sheet.

Figure 9:
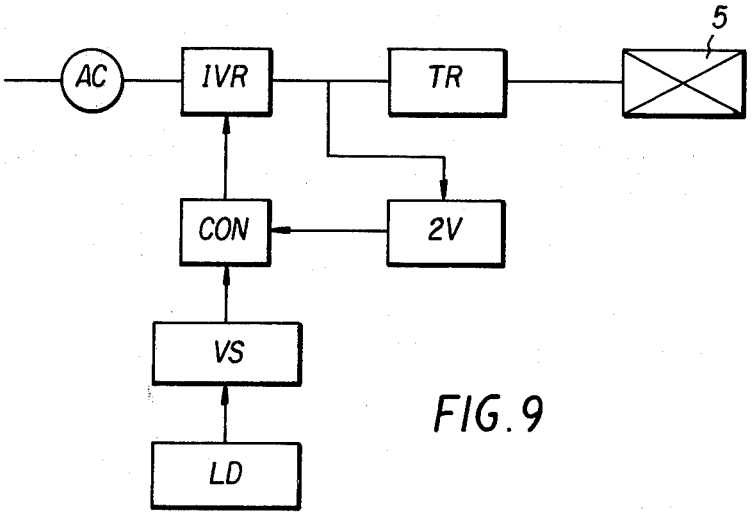
FIG. 9 is a flow-sheet showing the control process of the present invention.

FIG. 9 is a block diagram showing an example of the control process to be used in the process of the present invention for maintaining the relationship between the jet height by means of the electromagnetic pump and the bath surface level at the optimum state. As will be described later with reference to FIG. 10, this control process transmits the level of the bath surface detected by the bath surface level detector LD to a voltage setter VS, where the relationship between the jet height and the voltage is programmed beforehand so that such a voltage signal is transferred to a control apparatus CON so as to provide a necessary jet height. On the other hand, the secondary voltage 2 V at a given state is detected by an induction voltage regulator IVR, the signal of which also is transmitted to the control apparatus CON. Accordingly, the signal from the voltage setter VS is compared with the secondary voltage 2 V and an IVR-motor is controlled in such a direction as to minimize the deviation between them. The voltage set to the optimum voltage by the IVR is transmitted to the electromagnetic pump 5 by a transformer TR so that a driving force arising from the fresh shifting magnetic field is allowed to act on the hot dip coating metal itself and the jet height of the coating metal in contact with the metal sheet is controlled at a constant and optimum condition. When the level of the bath surface lowers as explained in FIG. 8, for example, the lowering is detected by the bath surface level detector LD and its measurement result is transmitted to the voltage setter VS. After comparison and calculation of the optimum voltage by the control apparatus CON, the result is transmitted by the transformer TR to the electromagnetic pump 5 so as to strengthen the shifting magnetic field of the hot-dip coating metal, to elevate the jetting pressure of the hot-dip coating metal and thus to control the amount of the metal to be brought into contact with the metal sheet at a constant level.

Figure 10:
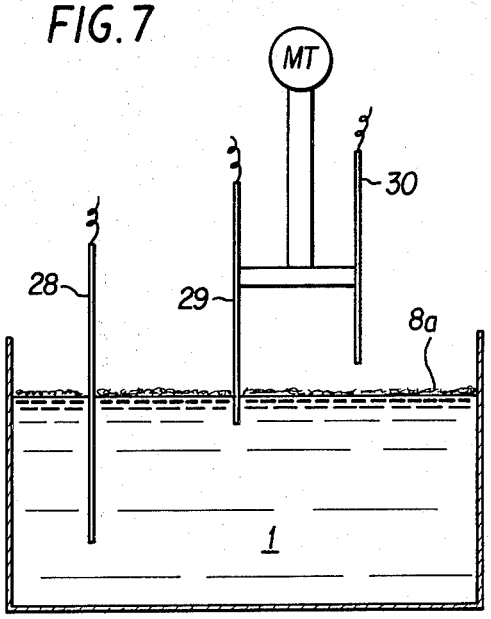
FIG. 10 is a schematic view of the bath surface level detector to be used in the process of the present invention.

Incidentally, there is no specific limitation to the construction of the bath surface level detector LD to be used in the present invention. For instance, a float switch (i.e. an electrode switch) using an electrode type such as shown in FIG. 10 may be employed. Namely, this detector uses electrodes 28, 29, 30 made of materials which are difficult to attack and difficult to wet by the hot-dip coating metal. Examples of such materials include carbon, a stainless steel, a chromium steel, Ni-Cr-Mo steel, tungsten, molybdenum and niobium. These materials are not affected adversely by the presence of floating matters (top-dross 8*a*) consisting of oxides of the hot-dip coating metal. If necessary, the portion of the electrodes that are brought into contact with the coating metal may of course be protected by the non-oxidizing gas such as reducing gas or inert gas in order to prevent the formation of the top-dross 8*a*.

The construction shown in FIG. 10 consists of one fixed electrode 28 and two mobile electrodes 29 and 30, the latter two being insulated electrically from each other and allowed to move integrally in the vertical direction by means of a motor MT while their tips are deviated from each other. The fixed electrode 28 is immersed in the hot-dip coating metal so that when the mobile electrodes 29, 30 are brought into contact with the hot-dip coating metal, a current flows through these electrodes 28, 29, 30. A circuit is incorporated so that when conduction is established in the lower electrode 29, lowering of the mobile electrode 29 by means of the motor MT is stopped and when conduction is cut off, lowering starts once again. Another circuit is also incorporated so that when conduction is established in the upper electrode 30, elevation of the mobile electrode 30 by means of the motor MT is initiated and when not, the operation of the motor MT stops. Accordingly, when the level of the bath surface lowers due to the carry-over of the hot-dip coating metal and conduction by the electrode 29 is thereby cut off, the motor MT is actuated to lower the electrode 29 until conduction is again established and the electrode 29 stops lowering. On the contrary, when the level of the bath surface is elevated due to charging of the hot-dip coating metal or metal ingot and conduction by the electrode 30 is established, the motor MT is actuated to elevate the electrode 30 and stops its operation when conduction is cut off. In this manner, the bath surface level is detected while the positions of the electrodes 29 and 30 are being adjusted. In addition to the level detector of the above-described type, there may be used a radiant ray type, a ultra-sonic type, a thermometer type, a float type, an electromagnetic type and so forth.

When the level of the bath surface is detected by the above-described means, the jet height of the hot-dip coating metal is adjusted in accordance with the process shown in FIG. 9, whereby the jet height of the coating metal is constantly retained at a predetermined level and, thereby ensuring uniform coating quality irrespective of fluctuation of the bath surface level.

Figure 7:
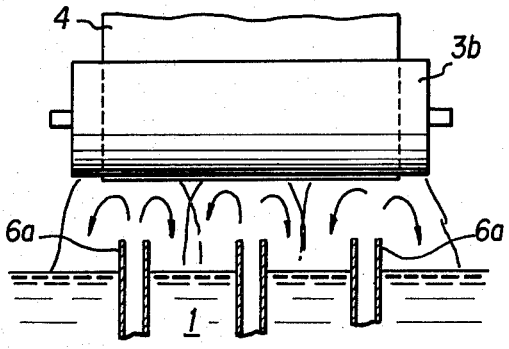
FIG. 7 is a sectional view of another example of the invention taken along line VII—VII in FIG. 1.
Figure 11:
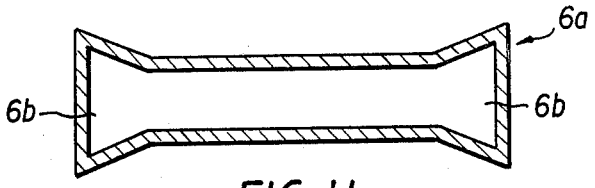
FIGS. 11, 12 and 13 are schematic sectional views of the nozzle mouth to be used in the one-sided, hot-dip coating process in accordance with the present invention.
Figure 12:
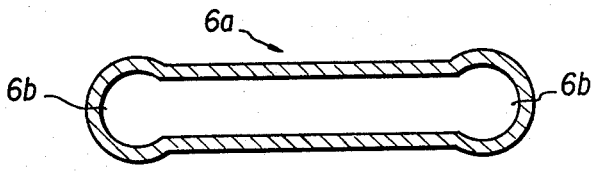
Figure 13:
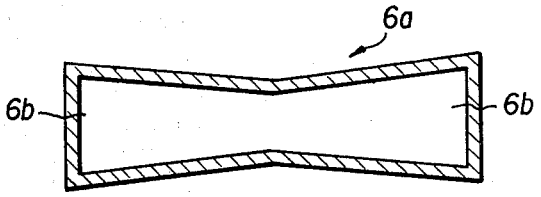

When the process of the present invention is applied to one-sided, hot-dip coating of a metal sheet having a relatively large transverse width, there may be a case where a plurality of nozzles 6*a* are disposed in the direction of width of the metal sheet as shown in FIG. 7 (which is a sectional view taken along line VII—VII indicated by an arrow in FIG. 1) or where a nozzle 6*a* having a flat mouth extending in the direction of width of the metal sheet and an expanded portion at its each end in comparison with its central portion is disposed such as shown in FIGS. 11 through 13 (in which 6*b* represents its expanded portion). In either case, there is no possibility that the hot-dip coating metal attaches to the guide rolls 3*a*, 3*b*.

Incidentally, the nozzle 6*a* such as shown in FIGS. 11 through 13 is used because such enables improvement in the jet pattern of the hot-dip coating metal. In other words, if the jet area at both end portions of the nozzle is expanded, the friction of the side wall at both ends can be minimized so that uniform jet height over the width substantially equal to the width of the nozzle can be eventually secured. As a result, it becomes possible to perform uniform one-sided, hot-dip coating of the metal sheet by the use of a nozzle having a width substantially equal to the width of the metal sheet. It is of course possible to dispose a plurality of nozzles having expanded portions at both thereof in the direction of width of the metal sheet in accordance with the width of the metal sheet and to jet the hot-dip coating metal by the electromagnetic pump.

In order to control the thickness of the coated film of the metal sheet that is subjected to the one-side hot-dip coating in accordance with the process of the present invention, it is of course possible to apply a gas wiping method which has conventionally been practiced in two sided, hot-dip coating. Namely, the coating film thickness can be controlled by disposing the wiping nozzle as indicated by reference numeral 10 in FIG. 1. As a wiping gas to be used in this instance, it is necessary to use the same reducing gas or the same inert gas as used inside the air-shielding cover used for the prevention of the oxidation of the metal sheet as a material to be hot-dip coated. When one-sided, hot-dip coating device for practicing the process of the present invention is to be incorporated into a reducing annealing installation in the actual line, the air-shielding cover 7 is interconnected to a reducing annealing furnace for reducing and annealing the metal sheet whereby a reducing gas is used as the wiping gas. This wiping gas may be used as a gas for reducing the metal sheet and cleaning its surface in the reducing annealing furnace as a prior step to the one-sided, hot-dip coating step of the metal sheet.

The following are examples of the coating work using the device shown in FIG. 1.

EXAMPLES 1

One-side galvanizing of a steel sheet is carried out under the condition shown in Table 1 and there is obtained an one-sided, hot-dip coated steel sheet of high quality having no round-about overlap of the hot-dip coating metal onto the non-coating surface.

TABLE 1

| Condition | Example A | Example B |
|---|---|---|
| Steel Sheet | | |
| Dimension (mm) | $0.8^{(t)} \times 914^{(w)}$ | $1.2^{(t)} \times 1{,}219^{(w)}$ |
| Line speed (m/min.) | 60 | 40 |
| Coating Bath | | |
| Composition | Zn-0.2% Al | Zn-0.18% Al |
| Temperature (°C.) | 460 | 450 |
| Electromagnetic Pump | | |
| Voltage (V) | 20 | 28 |
| Jet quantity (kg/sec) | 40 | 55 |
| Protrusive length of nozzle (mm) | 10 | 20 |
| Distance between steel sheet and bath surface (mm) | 60 | 50 |
| One-side coating weight (g/m$^2$) | 75 | 70 |

Since the present invention is constructed as described above, its effects may be summarized as follows.

(1) Being provided outside the bath pot for the hot-dip coating metal, the electromagnetic pump is prevented from contacting directly with the hot-dip coating metal and is capable of applying a driving force thereto. Hence, no heat-resisting or corrosion-proofing measure is necessary for the electromagnetic pump. Overheating of the electromagnetic pump due to the induction current can be prevented by fitting of a water-cooling copper pipe and the like. This is extremely advantageous for design and maintenance of the installation.

(2) The process of the present invention sucks up the hot-dip coating metal from about the intermediate portion inside the bath pot to thereby prevent attachment of the dross to the metal sheet to be hot-dip coated. Hence, it is possible to perfectly prevent inferior coating arising from the attachment of the dross.

(3) The jet nozzle is protruded from the surface level of the hot-dip coating metal in bath pot and the jet height can be optionally varied over a wide range by regulating the voltage to the electromagnetic pump. This arrangement enables fluctuation of the bath surface level to be easily controlled and ensures stable coating work for an extended period.

(4) In the process of the present invention, jetting of the hot-dip coating metal (or attachment of the coating metal to the metal sheet) is effected at the intermediate position of a pair of guide rolls, thereby preventing the attachment of the hot-dip coating metal to the guide rolls. Hence, it is possible to prevent round-about overlap of the hot-dip coating metal onto the non-coating surface of the metal sheet to be coated and to obtain an one-sided, hot-dip coated product having high quality with a high productibility while maintaining high yield of production, and (5) There is no specific limitation to the kind of the hot-dip coating metal. Namely, the process of the present invention may be adapted widely to the hot-dip coating of zinc, aluminum, lead and their alloys.

EXAMPLE 2

Figure 14:
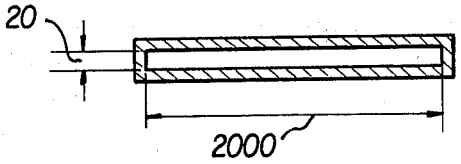
Figure 15:
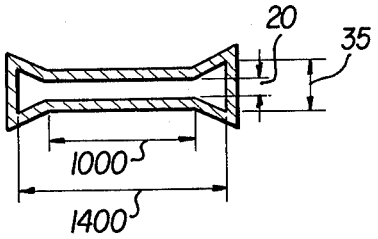

One-side galvanizing is effected to one-side of a steel sheet using jet nozzle of FIGS. 14 (comparative example) and 15 (working example) each having the shape and size (mm) as shown in the drawing under the condition illustrated in Table 2. The results are also shown in Table 2.

TABLE 2

| Coating Condition | Working Example | Comparative Example |
|---|---|---|
| Steel Sheet | | |
| Size (mm) | $0.8^{t} \times 1219^{w}$ | same as left |
| Line speed (m/min) | 60 | " |
| Coating Bath | | |
| Composition | Zn-0.8%Al | " |
| Temperature (°C.) | 460 | " |
| Electromagnetic Pump | | |
| jet quantity | 2 Kg/sec. | 3 Kg/sec. |
| capacity | 60 KW | 100 KW |
| power consumption | 50 KW | 80 KW |
| One-side coating weight | 65 g/m$^2$ | same as left |

As can be seen clearly from Table 2, uniform one-sided, galvanizing can be accomplished in accordance with the present invention even when the transverse width of the nozzle is reduced by about 30% in comparison with the nozzle of the comparative example, thereby enabling reduction of the jet quantity of zinc down to $\frac{2}{3}$ and to conserve the capacity and power consumption of the electromagnetic pump by about 40%.

What is claimed as new and desired to be secured by Letters Patent of the United States is:

1. A process for one-sided, hot-dip coating of a metal sheet in an apparatus including a molten metal bath, a pair of guide rolls disposed above said bath, an electromagnetic pump and at least one nozzle which comprises:

guiding and causing said metal sheet to be coated to travel over said molten metal bath by means of said pair of guide rolls diposed over above said bath;

sucking a hot-dip coating metal inside said molten metal bath by an electromagnetic pump disposed outside said bath and jetting said hot-dip coating metal through said molten metal bath from said at least one nozzle which protrudes beyond the surface of said bath between said pair of guide rolls;

bringing said hot-dip coating metal thus jetted into contact with the lower surface of said metal sheet over its entire range in its transverse direction while said metal sheet is travelling, thereby forming a coating layer of said hot-dip coating metal on the lower surface of said sheet;

measuring the bath surface level by means of a bath surface level detector; and controlling the input voltage to said electromagnetic pump in response to said step of measuring the bath surface level so as to hold the jet height of said hot-dip coating metal at a constant level.

2. The process for one-sided, hot-dip coating as defined in claim 1 wherein said metal sheet consists of steel sheet.

3. The process for one-sided, hot-dip coating as defined in claim 1 wherein said hot-dip coating metal comprises zinc, aluminum, lead and their alloys.

4. The process for one-sided, hot-dip coating as defined in claim 1 which further comprises holding said hot-dip coating metal, said metal sheet to be coated, said at least one nozzle and said pair of guide rolls in an atmosphere of a reducing gas or of an inert gas shielded from the external air in order to prevent oxidation of said metal sheet and forming said coating layer of said hot-dip coating metal on the lower surface of said metal sheet.

5. The process for one-sided, hot-dip coating as defined in claim 1 which further comprises jetting said hot-dip coating metal by means of said electromagnetic pump at a plurality of positions in the direction of the width of said metal sheet.

6. The process for one-sided, hot-dip coating as defined in claim 1 which further comprises controlling the thickness of the coated film of said metal sheet subjected to one-sided, hot-dip coating by gas wiping.

7. The process for one-sided, hot-dip coating as defined in claim 6 wherein said wiping comprises a reducing gas or an inert gas.

8. A process for one-sided, hot-dip coating of a metal sheet in an apparatus including a molten metal bath, a pair of guide rolls disposed above said bath, an electromagnetic pump and at least one nozzle having a flat mouth extending in the direction of the width of said metal sheet, both end portions of said mouth being expanded more than the central portion of said mouth, which comprises:

guiding and causing said metal sheet to be coated to travel over said molten metal bath by means of said pair of guide rolls disposed above said bath;

sucking a hot-dip coating metal inside said molten metal bath by an electromagnetic pump disposed outside said bath and jetting said hot-dip coating metal through said molten metal bath from said at least one nozzle which protrudes beyond the surface of said bath between said pair of guide rolls such that the jet area of flow of said jet of hot-dip metal is expanded so as to have a width substantially equal to that of said metal sheet; and bringing said hot-dip coating metal thus jetted into contact with the lower surface of said metal sheet over its entire range in its transverse direction while said metal sheet is travelling, thereby forming a coating layer of said hot-dip coating metal on the lower surface of said sheet.

* * * * *

UNITED STATES PATENT AND TRADEMARK OFFICE

CERTIFICATE OF CORRECTION

PATENT NO. : 4,254,158

DATED : March 3, 1981

INVENTOR(S) : TOSHIO FUKUZUKA ET AL

It is certified that error appears in the above—identified patent and that said Letters Patent is hereby corrected as shown below:

Please correct the Foreign Application Priority Data to read as follows:

[30]--Foreign Application Priority Data

Jan. 30, 1978 [JP] Japan.....53/9656

Jun. 28, 1978 [JP] Japan.....53/89630

Jul. 28, 1978 [JP] Japan.....53/92981 -rather than-

[30]--Foreign Application Priority Data

Jan. 1, 1978 [JP] Japan.....53/9656

Jun. 28, 1978 [JP] Japan.....53/89630

Jul. 28, 1978 [JP] Japan.....53/92981 as it now appears.

Signed and Sealed this

Nineteenth Day of May 1981

[SEAL]

Attest:

RENE D. TEGTMEYER

Attesting Officer

Acting Commissioner of Patents and Trademarks